United States Patent [19]

Miyasaka et al.

[11] Patent Number: 5,030,993

[45] Date of Patent: Jul. 9, 1991

[54] SYNCHRONOUS DRIVING APPARATUS FOR A SCANNING EXPOSURE TYPE REPRODUCING APPARATUS

[75] Inventors: Eiji Miyasaka; Masayuki Handa; Morihiro Takeda, all of Shiga, Japan

[73] Assignee: Dainippon Screen Mfg. Co., Ltd., Japan

[21] Appl. No.: 222,206

[22] Filed: Jul. 21, 1988

[30] Foreign Application Priority Data

Jul. 22, 1987 [JP] Japan ..... 62-184298

[51] Int. Cl.[5] ..... G03G 15/28

[52] U.S. Cl. ..... 355/234; 355/235

[58] Field of Search ..... 355/233, 234, 230, 235; 271/272; 226/181

[56] References Cited

U.S. PATENT DOCUMENTS 3,861,613 1/1975 Tanaka et al. ..... 355/212 X
4,525,058 6/1985 Hirabayashi et al. ..... 355/282
4,607,836 8/1986 Miyasaka ..... 355/234 X

FOREIGN PATENT DOCUMENTS 1298791 3/1971 United Kingdom .
2121009 4/1983 United Kingdom .

OTHER PUBLICATIONS

Bhatia, Chandrakant R., "Document Turnover Mechanism", *Xerox Disclosure Journal,* vol. 7, No. 3, May/Jun. 1982, pp. 133-134.

*Primary Examiner*—A. T. Grimley
*Assistant Examiner*—Nestor R. Ramirez
*Attorney, Agent, or Firm*—Ostrolenk, Faber, Gerb & Soffen

[57] ABSTRACT

A synchronous driving apparatus for use in a scanning exposure type reproducing apparatus. A scanning system and a recording sheet are moved in synchronization without regard to changes in temperature.

14 Claims, 5 Drawing Sheets

SYNCHRONOUS DRIVING APPARATUS FOR A SCANNING EXPOSURE TYPE REPRODUCING APPARATUS

BACKGROUND OF THE INVENTION

1. Field of the Invention

The present invention relates to a scanning exposure type reproducing apparatus such as a reproducing camera, an electrophotographic copying machine and the like, and more specifically to a synchronizing apparatus, that is, a synchronous driving apparatus for moving either an original holding frame or an optical system in synchronization with a recording sheet.

2. Description of the Prior Art

A synchronous driving apparatus of particular interest to the present invention is disclosed in, for example, Japanese Utility Model Laying-Open Gazette No. 81648/1986. FIG. 1 is a cross-sectional view showing the synchronous driving apparatus disclosed therein and FIG. 2 is a perspective view showing the main portion thereof.

Referring to FIGS. 1 and 2, a conventional synchronous driving apparatus comprises an endless steel belt 52 which is fixed to an original holding frame 51 and which moves according to the movement of the frame. The endless belt 52 is wound around a driving pulley 53. The driving pulley 53 drives a driving roller 54 which is provided coaxially with the driving pulley 53. The driving roller 54 rotates a feeding roller 56 and the feeding roller 56 feeds an image recording sheet 55. A pressing roller 57 presses the image recording sheet 55 onto the feeding roller 56.

The conventional apparatus forms an image on the image recording sheet 55 in synchronization with the scanning of the original. Thus if scanning and movement of the image recording sheet 55 are not carried out at the same speed, the image on the sheet 55 will be skewed. In order to prevent this problem, the conventional apparatus is carefully structured as described in the following. The driving pulley 53 and the driving roller 54 are made of materials which have the same expansion coefficient. The pulley 53 and the roller 54 have the same diameter. Therefore, even if there is a change in temperature, the diameters of the driving pulley 53 and the driving roller 54 will be the same, and their speeds of rotation will be the same. Consequently, there will be no difference between the speed of the original holding frame 51 and the speed of the image recording sheet 55, which would be otherwise caused by thermal expansion derived from a change in temperature.

In the conventional synchronous driving apparatus, synchronization between the rotation of the feeding roller and the movement of the original holding frame can be maintained even if there is a change in temperature. However, even when such synchronization is maintained, the quality of the reproduced and recorded image is sometimes degraded. The reason is as follows. Since the feeding pressing roller 57 (which is formed of rubber) presses the image recording sheet 55 on to the feeding roller 56, the speed of the feeding roller 56 and the image recording sheet 55 is theoretically the same. However, in practice when there is a change in temperature, the hardness of the rubber forming the feeding roller 56 varies, and the volume thereof expands or contracts. Consequently, the diameter of the feeding roller 56 changes. This causes a change in the coefficient of friction between the roller 57 and the image recording sheet 55. Therefore, the friction between the image recording sheet 55 and the feeding roller 56 changes as a function of temperature. Consequently, even if the driving pulley 53 is rotated at a constant speed, the image recording sheet 55 is not necessarily moved at a constant speed.

SUMMARY OF THE INVENTION

Therefore, one object of the present invention is to provide a synchronous driving apparatus for a scanning exposure type reproducing apparatus in which image quality is not degraded.

Another object of the present invention is to provide a synchronous driving apparatus in which the image formed on an image recording sheet is not skewed.

A further object of the present invention is to provide a synchronous driving apparatus apparatus in which the image recording sheet and the original holding frame are fed synchronously.

A still further object of the present invention is to provide a synchronous driving apparatus in which the image recording sheet and the original holding frame are moved synchronously without regard to change in temperature.

A still further object of the present invention is to provide a synchronous driving apparatus having a simple structure in which image quality of the image is not degraded.

The above described objects of the present invention can be attained by generating the same amount of slip between the feeding roller and the image recording sheet as when moving the original holding frame and the like, regardless of the ambient temperature. If slip between the feeding roller and the image recording sheet is generated when the original holding frame is moved, the original holding frame slips by the same amount of slip as the slip of the image recording sheet. Therefore, the speed of the image recording sheet will be the same as the speed of the original feeding frame. Consequently, the quality of the image formed on the image recording sheet is not degraded.

The invention is directed to a method and apparatus for forming a high quality image regardless of temperature changes. The apparatus includes moving means for moving a component of an image-forming system; feeding means for feeding a sheet to be exposed past an image-formation position by applying a first frictional force to the sheet; and driving means for driving the moving means by applying a second frictional force to the moving means. The first frictional force and the second frictional force are equivalent to each other regardless of changes in temperature so that the movement of the component and the feeding of the sheet are synchronized.

According to a preferred embodiment of the present invention, the synchronizing apparatus for a scanning exposure type reproducing apparatus comprises: first roller means for winding and feeding an image recording sheet with a first frictional force between the first roller means and the image recording sheet with the frictional force having prescribed fluctuation characteristics dependent on temperature; second roller means operatively coupled to the first roller means, means for applying a second frictional force between the first and second roller means; the second frictional force having the same fluctuation characteristics as the prescribed fluctuation characteristics of the first frictional force; and a scan moving portion for moving the original or an optical system for scanning in synchronization with the rotation of the second roller means.

Since the preferred apparatus above described components, any temperature-induced change of the coefficient of friction between the first and second roller means coincides with a temperature-induced change of the coefficient of friction between the image recording sheet and the first roller means. Therefore, the amount of slip which occurs between the two due to temperature change is the same. Consequently, the image formed on the image recording sheet is not skewed.

According to a more preferred embodiment of the present invention, the first roller means is directly in contact with the second roller means and the first roller means has at least the surface thereof formed of elastic material and the second roller means has at least the surface thereof formed of stainless steel.

Since the preferred apparatus apparatus comprises the above-described components, the apparatus can be structured with a small number of rollers and with simple materials. Consequently, an uncomplicated synchronous driving apparatus is provided which can prevent degradation of image quality.

These objects and other objects, features, aspects and advantages of the present invention will become more apparent from the following detailed description of preferred embodiments when taken in conjunction with the accompanying drawings.

DESCRIPTION OF THE PREFERRED EMBODIMENTS

Figure 1:
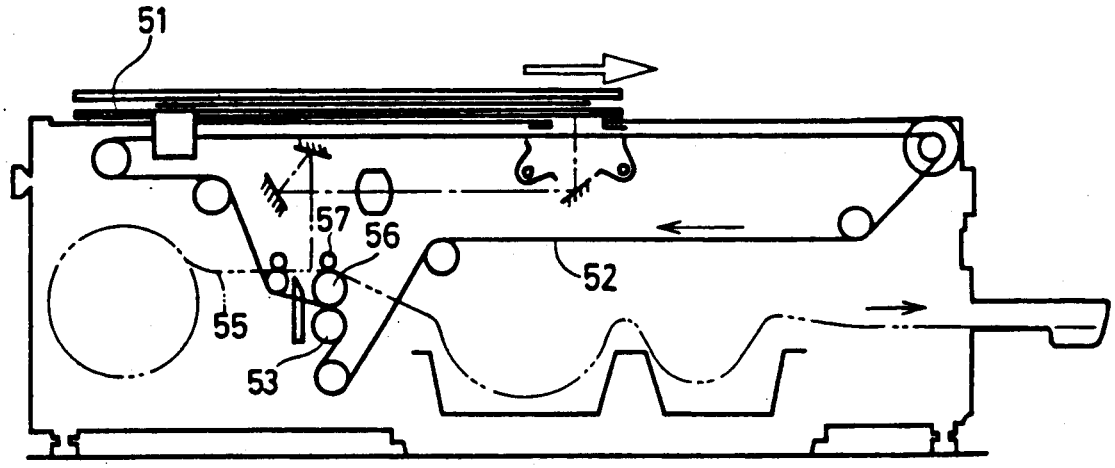
FIG.1 PRIOR ART
FIG. 1 is a cross-sectional view showing a conventional synchronous driving apparatus for a scanning exposure type reproducing apparatus.
Figure 2:
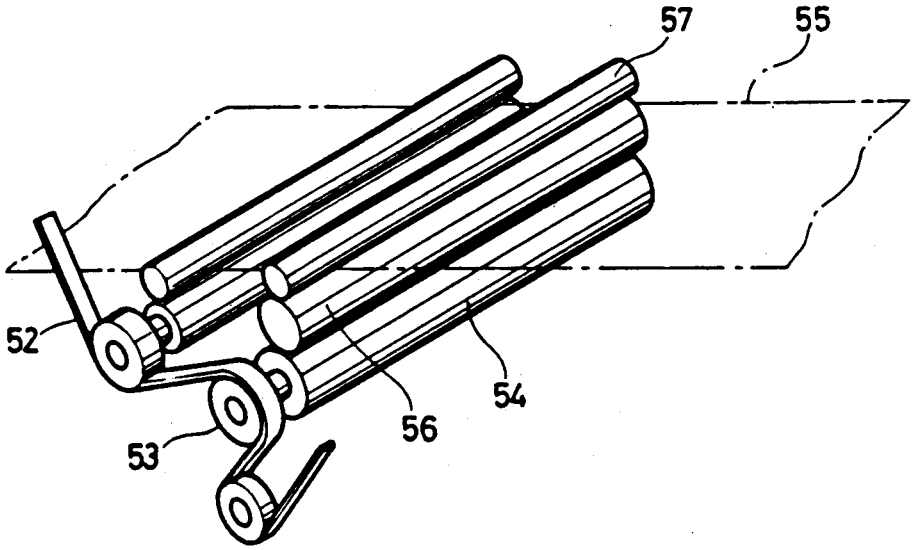
FIG.2 PRIOR ART
FIG. 2 is a perspective view showing the main portion of FIG. 1.
Figure 3:
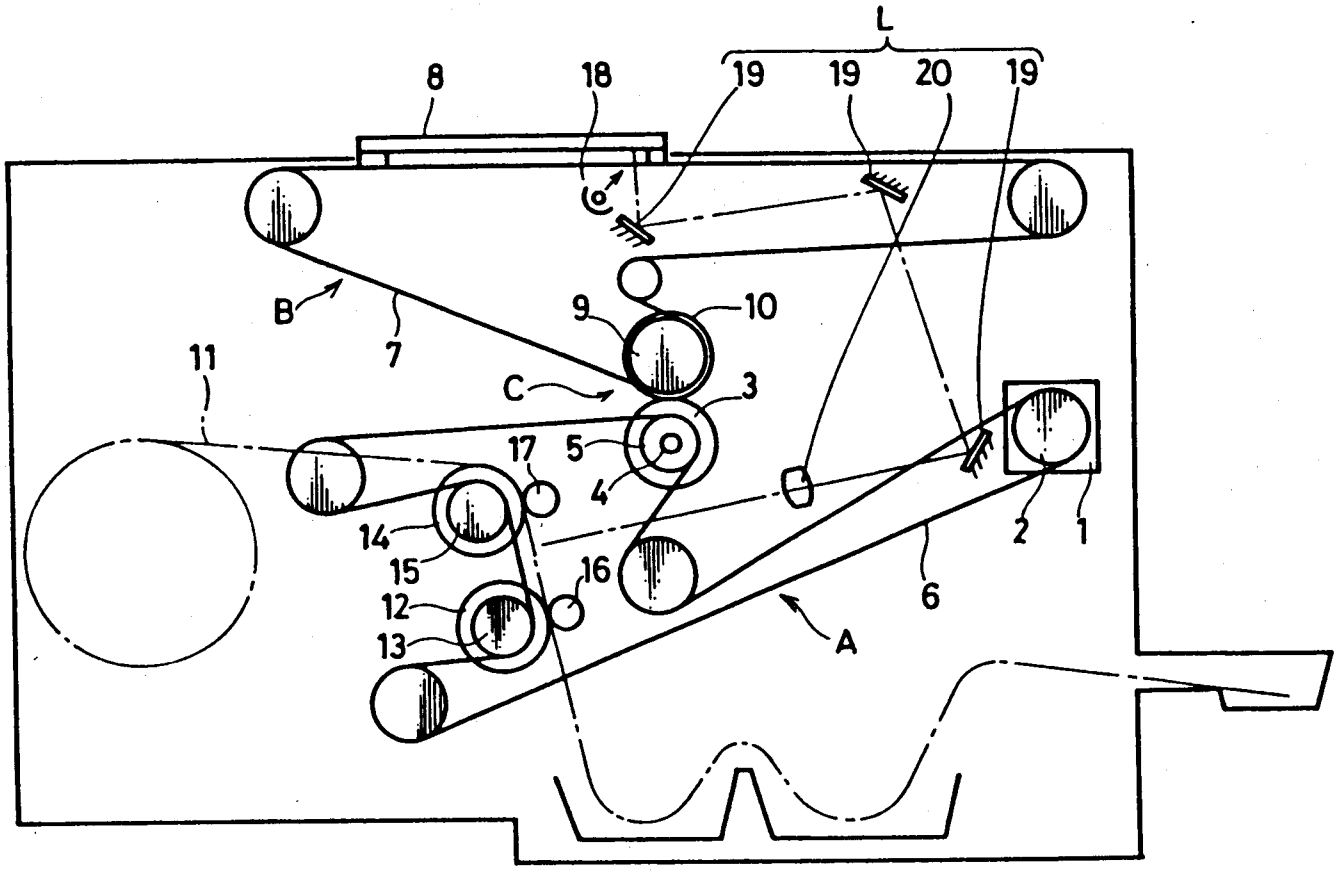
FIG. 3 is a schematic cross-sectional view of a direct plate reproducing camera.
Figure 4:
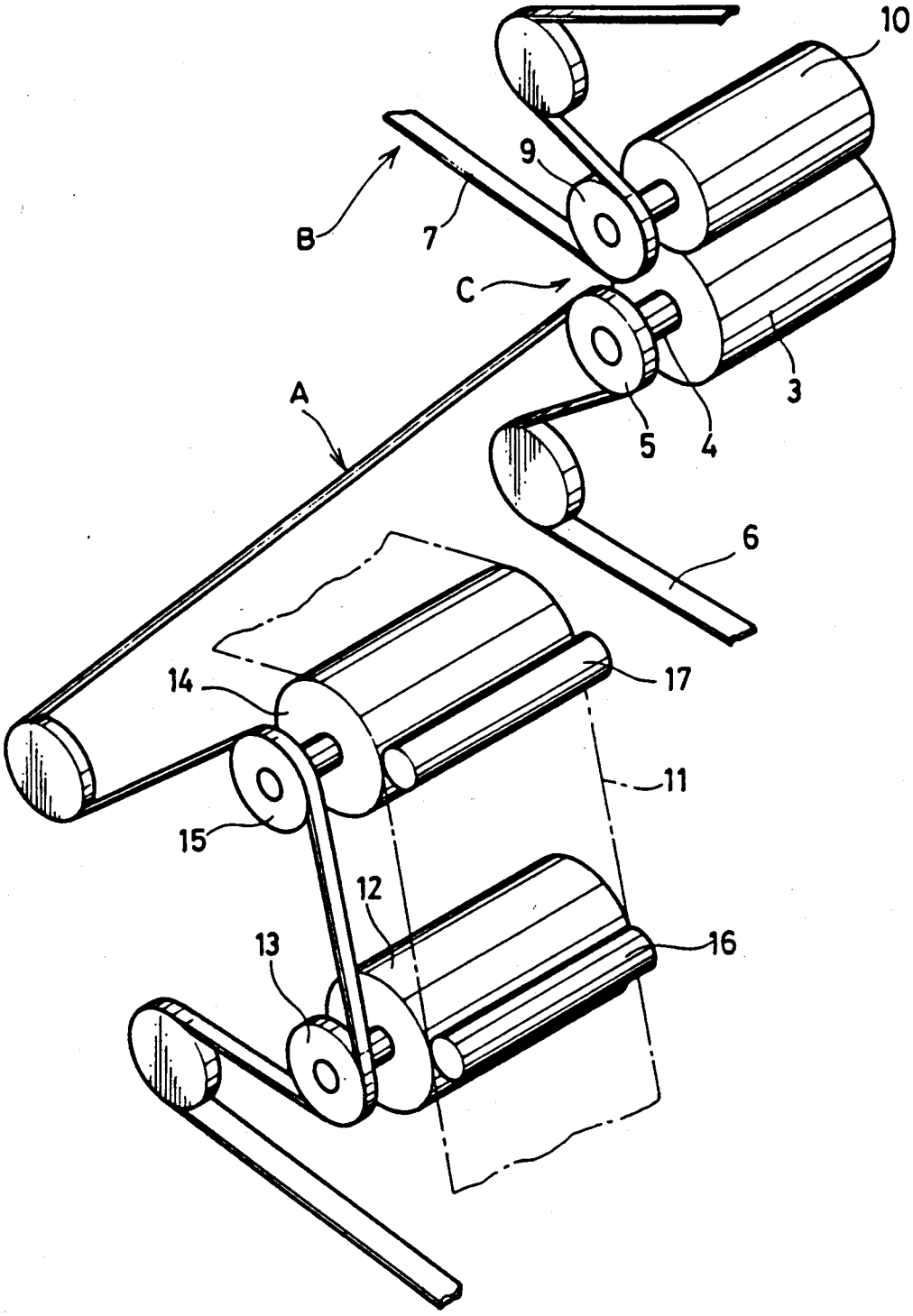
FIG. 4 is a perspective view showing the main portion of FIG. 3.

FIG. 3 is a schematic cross-sectional view of a direct plate making apparatus (which is an example of an scanning exposure type reproducing apparatus). FIG. 4 is a perspective view of the main portion thereof. The apparatus comprises a driving system A for feeding an image recording sheet 11, a scanning system B for scanning an original, and a power transmitting mechanism C for transmitting power from the driving system A to the scanning system B.

The driving system A comprises: a motor 1 containing a reducer; a driving pulley 2 attached to the motor 1; an input roller 3 (made of rubber) constituting a portion of the power transmitting mechanism; a transmission pulley 5 fixed to a supporting axis of the input roller 3; a feeding roller 12 for feeding the image recording sheet 11; an image recording sheet tensing roller 14 for applying tension onto the image recording sheet 11; pressing rollers 16 and 17 for preventing the image recording sheet 11 from slipping on the feeding roller 12 and on the image recording sheet tensing roller 14; a feeding pulley 15 for driving the feeding roller 14; a tensing pulley 13 for driving the image recording sheet tensing roller 12; and a steel belt 6 for transmitting power to the driving pulley 2, the driven pulley 5, the feeding pulley 15 and the tensing pulley 13.

The scanning system B comprises: an original holding frame 8 for holding an original; an optical system L for scanning and exposing the original holding frame 8; an endless steel belt 7 for moving the original holding frame 8 for scanning; a driving pulley 9; an endless steel belt 7 adapted to be moved by the driving pulley 9; and an output roller 10 provided coaxially with the driving pulley 9 for rotating the driving pulley 9.

The power transmitting mechanism C includes a portion of the scanning system B and a portion of the driving system A. The mechanism C includes: an input pulley 3 rotated by a driven pulley 5 which is rotated by the steel belt 6; and an output roller 10 rotating in contact with the input pulley 3 for driving the endless steel belt 7 through the driving pulley 9.

The operation will be described in the following.

A steel belt 6 constituting the driving system A is wound around a feeding side pulley 13 arranged on a support axis of the feeding roller 12, an image recording sheet material tensing side pulley 15 arranged on a support axis of the image recording sheet material tensing roller 14, a driven pulley 5 fixed on a support axis of the input roller 3, and so on. Therefore, when the motor 1 is driven, the feeding roller 12, the tensing roller 14 and the input roller 3 are rotated. When the input roller 3 is rotated, the output roller 10 is also rotated. Thus, when the driving pulley 9 is rotated, the endless steel belt 7 is rotated. Consequently, the original holding frame 8 is moved.

In the above described manner, the feeding roller 12 and the original holding frame 8 are synchronously driven by a single motor 1.

Pressing rollers 16 and 17 are in pressure contact with the peripheral surfaces of the feeding roller 12 and the tensing roller 14, respectively. The image recording sheet material 11 is fed by the rotation of the feeding roller 12, being pressed onto the feeding roller 12 and onto the image recording sheet material tensing roller 14 by the pressing rollers 16 and 17. The feeding roller 12 and the image recording sheet material tensing roller 14 are formed of rubber, and the pressing rollers 16 and 17 are formed of stainless steel.

The reason why the present invention is structured as described above will be hereinafter described.

The disadvantages of the prior art exist because, the coefficient of friction between the image recording sheet and the rubber feeding roller fluctuates as temperature changes. Therefore, even if the feeding roller is rotated at a constant speed, the image recording sheet is not fed at the same speed. Meanwhile, the original holding frame is moved at the same speed as the rotation speed of the feeding roller. Consequently, the original holding frame and the image recording sheet are not moved synchronously.

Therefore, in the present invention, the apparatus is structured such that the change in the coefficient of friction derived from a change in temperature between the rubber feeding roller and the image recording sheet also affects the movement of original holding frame. More specifically, in the present invention, the change in the coefficient of friction occurs in the power transmitting mechanism C.

In order to understand the present invention more clearly, features of the preferred embodiment will be described in detail with reference to FIG. 4. The image recording sheet 11 is fed by the feeding roller 12 and the pressing roller 16. The coefficient of friction between the image recording sheet 11 and the feeding roller 12 fluctuates according to change in temperature. Therefore, the speed of the image recording sheet 11 does not coincide with the moving speed of the steel belt 6. Meanwhile, in the power transmitting mechanism C, the driven pulley 5 (and thus the input roller 3) is rotated at the same speed as the moving speed of the steel belt. The input roller 3 is formed of the same rubber material as the feeding roller 12 and is rotatably in contact with the output roller 10 (which is made of stainless steel). Stainless steel is selected for this purpose for the following reason. If practical, at least the surface of the output roller 10 would be formed of the same material as the image recording sheet 11 to present the same frictional state as presented by the feeding roller 12. However, the image recording sheet 11 is formed of paper or the like and such material cannot be used as the surface of the roller 10. Theoretically, any material can be employed provided the coefficient of friction thereof with the rubber roller changes in the same manner as does the image recording sheet 11. It has been experimentally determined that stainless steel is the most preferable material satisfying the above described conditions.

Either the input roller or output roller should be made of rubber and the other should be made of stainless steel. Any material can be employed provided it has the same frictional characteristics as the image recording sheet.

Figure 5:
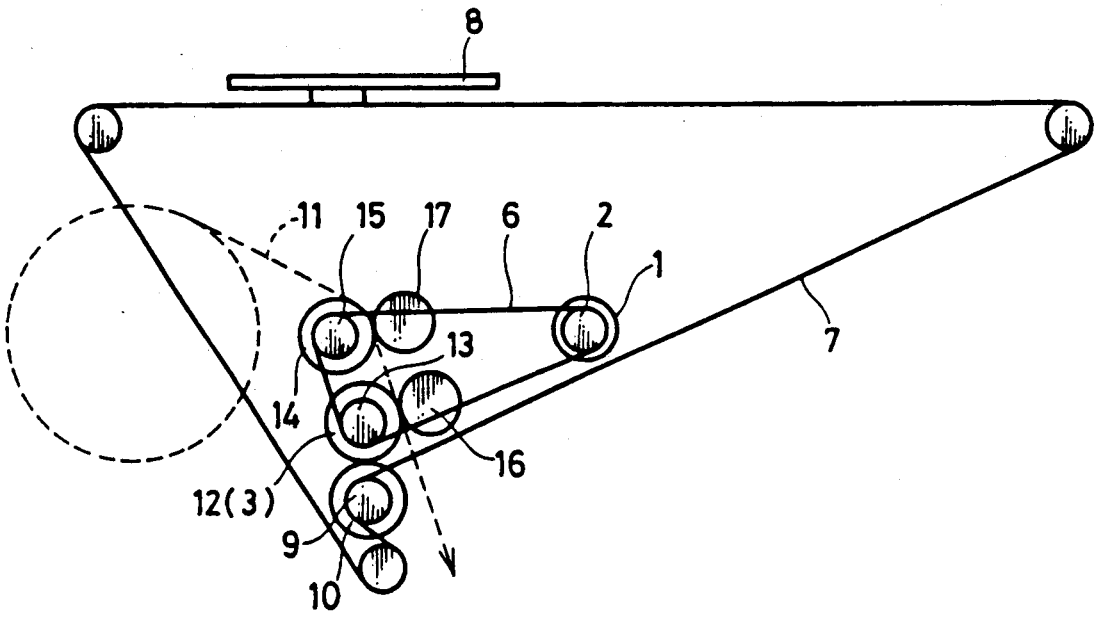

FIG. 5 is a schematic diagram showing a modification of the present invention in which the feeding roller 12 also serves as the input roller 3.

Figure 6:
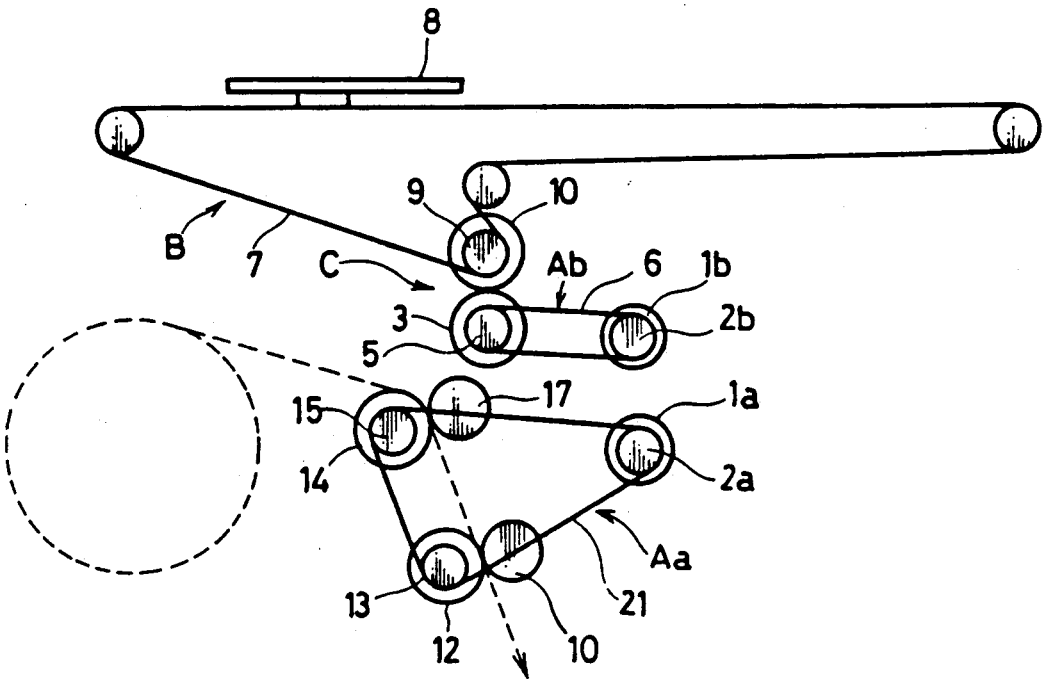

FIG. 6 shows the present invention applied to a variable magnification type copying apparatus, comprising two motors 1*a* and 1*b* which are capable of synchronous operation. This apparatus includes a feeding side driving system. Aa in which a pulley 2*a* driven by the motor 1*a* and a feeding pulley 13 are cooperatively coupled by an endless belt 21; a scanning moving side driving system Ab in which a pulley 2*b* driven by the other motor 1*b* and a driving pulley 5 are cooperatively coupled by an endless belt 6; a scanning moving system B having an endless belt 7 on which an original holding frame 8 is fixed cooperatively coupled with the scanning moving side driving system Ab and through a power transmitting mechanism C by roller contact.

Figure 7:
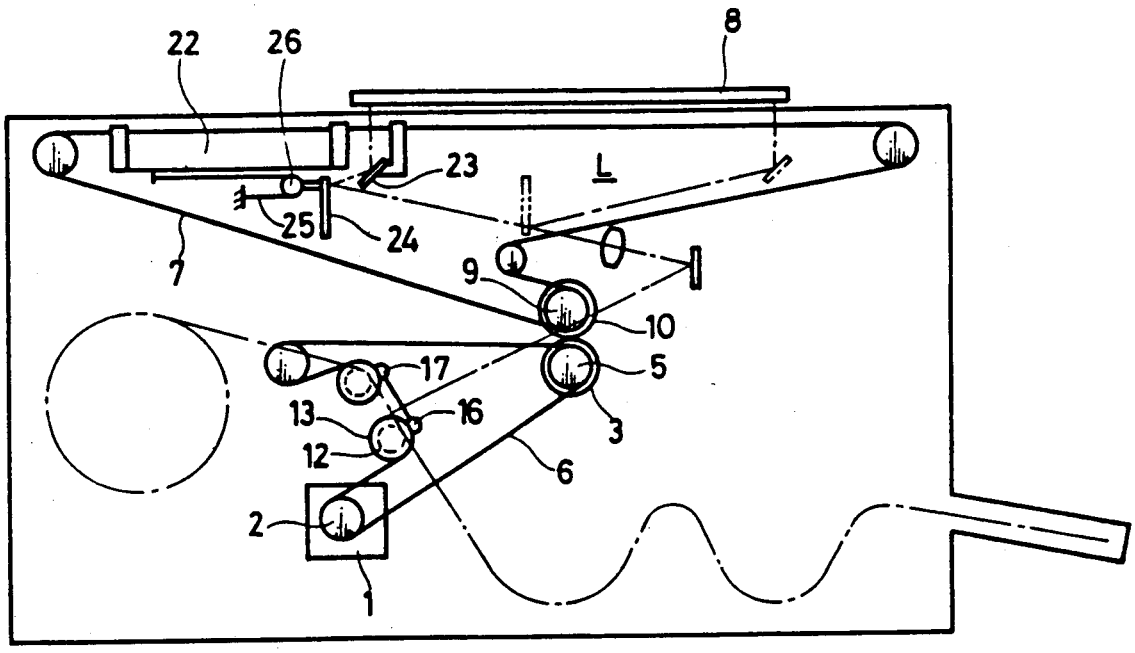
FIGS. 5 to 7 are schematic diagrams showing other embodiments of the present invention.

Although description was given of a case in which the original holding frame 8 is moved for scanning in association with a fixed optical system L in each of the above embodiments, the present invention can be also applied to apparatuses in which the optical system L is moved relative to a fixed original holding frame 8, as in another embodiment of the present invention shown in FIG. 7.

In FIG. 7, the numeral 22 denotes a scanning moving member which supports the optical system L, 23 denotes a first mirror fixed on the scanning moving member, and 24 denotes a second mirror, with the optical system L being driven between the position shown by the solid line 7 and the position shown in phantom lines. The second mirror 24 moves integrally with a moving pulley 26 which is surrounded by a belt 25 having one end supported by the scanning moving member 22 and the other end supported by the body of the image copying apparatus. The mirror moves along a shorter stroke than does the member 22.

In the present invention, either the input roller or the output roller is formed of a material such as stainless steel (which has the same tendency to change its coefficient of friction in response to changes as does the image recording sheet) and the other is formed of rubber. The output association with the change of the temperature as the image recording sheet, and the other of the input roller and the output roller is formed of rubber. The output roller is driven through the input roller. Thus, any change in frictional force will be the same as the change in frictional force caused by the change of the temperature between the feeding roller and the image recording sheet. Therefore, even if the rotational speed of the feeding roller and the travel speed of the image recording sheet differ from each other due to a temperature-induced change in frictional force, the travel speed of the scanning moving member changes accordingly. The image recording sheet material and the scanning moving member are wherefore exactly in synchronization with each other. Consequently, a synchronous driving apparatus for a scanning exposure type reproducing apparatus can be provided in which image quality is not degraded even when temperature changes.

Although the present invention has been described and illustrated in detail, it is clearly understood that the same is by way of illustration and example only and is not to be taken by way of limitation. The spirit and scope of the present invention should be limited only by the terms of the appended claims.

What is claimed is:

1. An apparatus for forming a high quality image regardless of temperature changes, said apparatus comprising:

moving means for moving a component of an image-forming system;

feeding means for feeding a sheet to be exposed past an image-forming position by applying a first frictional force to said sheet; and driving means for driving said moving means by applying a second frictional force to said moving means, said first frictional force and said second frictional force being equivalent to each other regardless of changes in temperature so that the movement of said component and the feeding of said sheet are synchronized;

wherein said feeding means includes a first roller, said moving means includes a second roller, and said first roller contacts said second roller.

2. The apparatus of claim 1, further comprising a single driving source for driving said first roller and said second roller.

3. An apparatus for forming a high quality image regardless of temperature changes, said apparatus comprising:

moving means for moving a component of an image-forming system;

feeding means for feeding a sheet to be exposed past an image-forming position by applying a first frictional force to said sheet; and driving means for driving said moving means by applying a second frictional force to said moving means, said first frictional force and said second frictional force being equivalent to each other regardless of changes in temperature so that the movement of said component and the feeding of said sheet are synchronized;

wherein said feeding means includes a roller having a surface formed of rubber; and wherein said moving means includes a second roller having a surface formed of stainless steel.

4. The apparatus of claim 3, further comprising: a second driving source for driving said feeding means.

5. An apparatus for forming a high quality image regardless of temperature changes, said apparatus comprising:

moving means for moving a component of an image-forming system;

feeding means for feeding a sheet to be exposed past an image-forming position by applying a first frictional force to said sheet; and driving means for driving said moving means by applying a second frictional force to said moving means, said first frictional force and said second frictional force being equivalent to each other regardless of changes in temperature so that the movement of said component and the feeding of said sheet are synchronized;

wherein said component is an optical system.

6. The apparatus of claim 5, wherein said feeding means includes a first roller and said moving means includes a second roller, said driving means including a third roller, and said second roller contacts said third roller.

7. The apparatus of claim 6, wherein said first roller has a surface formed of rubber, said second roller has a surface formed of stainless steel, and said third roller has a surface formed of rubber.

8. An apparatus for forming a high quality image regardless of temperature changes, said apparatus comprising:

moving means for moving a component of an image-forming system;

feeding means for feeding a sheet to be exposed past an image-forming position by applying a first frictional force to said sheet; and driving means for driving said moving means by applying a second frictional force to said moving means, said first frictional force and said second frictional force being equivalent to each other regardless of changes in temperature so that the movement of said component and the feeding of said sheet are synchronized;

wherein said component is an original to be reproduced.

9. The apparatus of claim 8, wherein said feeding means includes a first roller, said moving means includes a second roller, said driving means including a third roller, and said second roller contacts said third roller.

10. The apparatus of claim 9, wherein said first roller has a surface formed of rubber, and said third roller has a surface formed of a rubber.

11. The apparatus of claim 10, wherein said second roller has a surface formed of stainless steel.

12. A method of forming a high quality image regardless of temperature changes, said method comprising the steps of:

operating a moving means and thereby moving a component of an image-forming system, said moving means including a first roller;

operating a feeding means and thereby feeding a sheet to be exposed past an image-formation position by applying a first frictional force to said sheet, said feeding means including a second roller which contacts said first roller; and driving said moving means by applying a second frictional force to said moving means, said first frictional force and said second frictional force being equivalent to each other regardless of changes in temperauture so that the movement of said component and the feeding of said sheet are synchronized.

13. The method of claim 12, wherein said component is an original to be reproduced.

14. The method of claim 12, wherein said component is an optical system.

* * * * *